United States Patent [19]

Kirsch

[11] 4,017,098

[45] Apr. 12, 1977

[54] SAFETY BINDINGS FOR SKIS

[76] Inventor: Bernhard Kirsch, Im Litzelholz 23, 55 Trier-Biewer, Germany

[22] Filed: Sept. 5, 1975

[21] Appl. No.: 610,743

[30] Foreign Application Priority Data

| | | |
|---|---|---|
| Sept. 7, 1974 | Germany | 2442902 |
| Mar. 6, 1975 | Germany | 2509809 |

[52] U.S. Cl. ..... 280/625

[51] Int. Cl.[2] ..... A63C 9/08

[58] Field of Search ..... 280/625, 626, 634, 635

[56] References Cited

UNITED STATES PATENTS

| | | | |
|---|---|---|---|
| 3,232,631 | 2/1966 | Witschard | 280/625 |
| 3,627,341 | 12/1971 | Lusser | 280/625 |
| 3,806,143 | 4/1974 | Wyss | 280/625 |

*Primary Examiner*—Robert R. Song

*Attorney, Agent, or Firm*—Robert W. Beach; R. M. Van Winkle

[57] ABSTRACT

This invention relates to safety bindings for skis of the kind having a front binding which consists of two spaced toe-clamps which grip the toe of the boot and which are mounted on outwardly pivotable arms.

According to the invention, when these arms are locked in the closed position, they are capable of release in opposition to the pressure of a spring. The force of such spring acts in the direction opposite to the direction of ski movement. In response to a sudden rearward force on the ski, the two toe-clamps can be moved apart simultaneously laterally of the ski a distance greater than the width of the boot.

7 Claims, 23 Drawing Figures

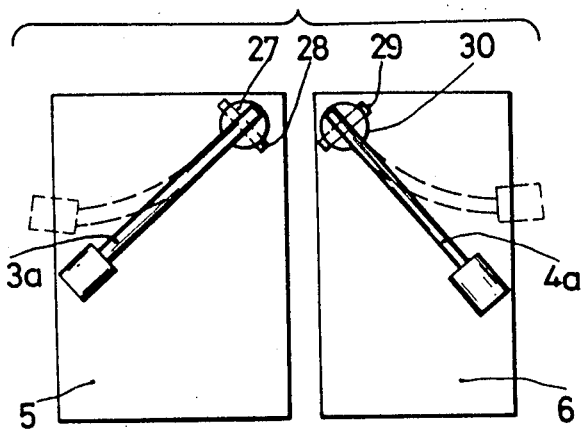
Fig.13
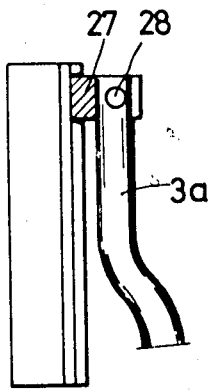
Fig.14
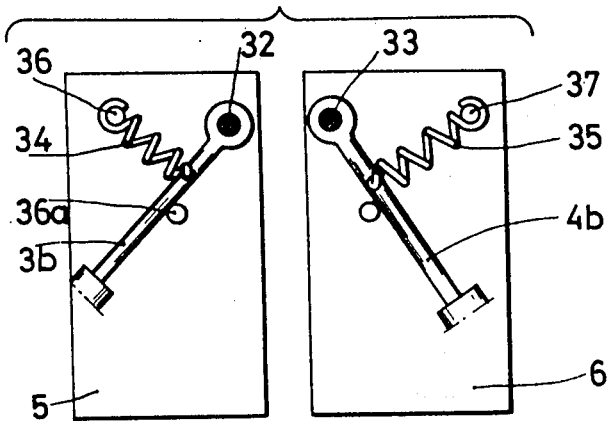
Fig.15
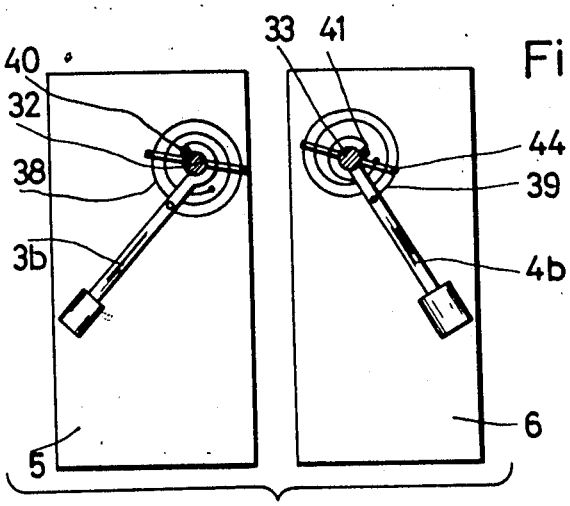
Fig. 16
Fig.17
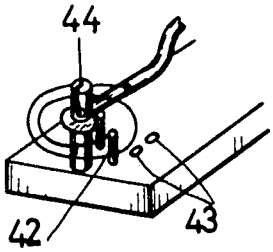

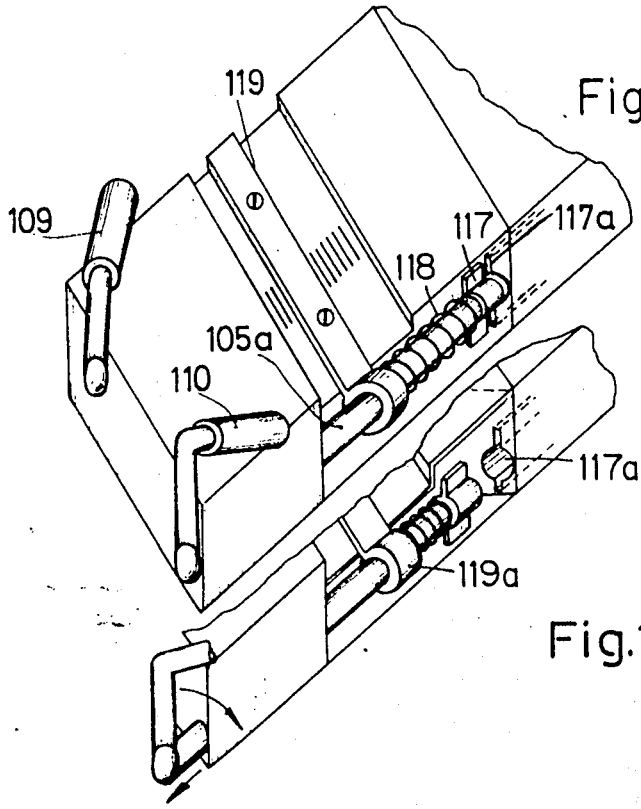
Fig. 19
Fig. 19A
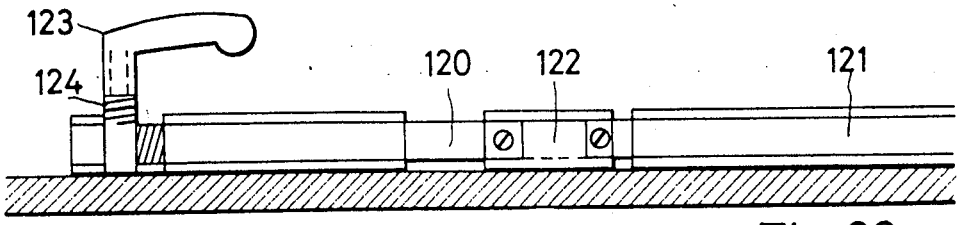
Fig. 20
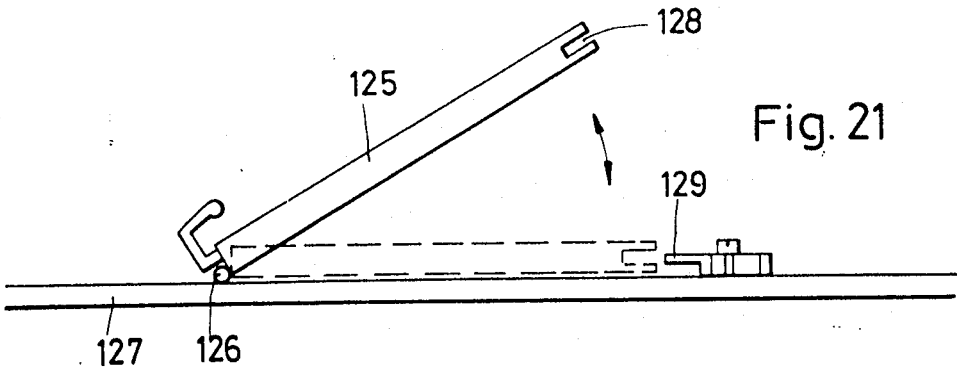
Fig. 21

SAFETY BINDINGS FOR SKIS

BACKGROUND OF THE INVENTION

The present invention relates to safety bindings for skis of the kind having a front binding which consists of two spaced toe-clamps which grip the toe of the boot and which are mounted on outwardly pivotable arms.

In such safety bindings, the front bindings are responsible for releasing the ski-boot from the binding in a sideways direction when the pressure against one toe-clamp or the other exceeds a certain level. There is however a disadvantage to such front bindings in that the binding either does not open or fails to open properly when the ski encounters an obstacle almost head-on, as may be the case when, for example, the skier meets a slope or runs into deep snow. There are therefore certain types of serious injury which known ski-bindings cannot prevent.

It is therefore an object of the invention to so design a safety binding for skis by which the front binding releases the ski-boot when an obstacle is encountered in such a way that the ski-boot, which is held at toe and heel, can slip out of the binding in the longitudinal direction of the ski in the same direction as that in which the skier is moving without this movement being obstructed by any part of the binding in front of the toe of the boot.

SUMMARY OF THE INVNETION

This object is achieved by making the arms carrying the toe-clamps when locked in the closed position, capable of being released in opposition to the pressure exerted by a spring which acts in the direction opposite the direction of ski movement, so that the two toe-clamps can spread apart simultaneously a distance which is greater than the width of the boot.

Advantageously, each clamp is mounted on the front end of a rotatable rod which extends in the longitudinal direction of the ski, which rod is spring-loaded, rotatable about its longitudinal axis, and displaceable longitudinally of the ski relative to rod mounting means arranged near one edge of the ski.

BRIEF DESCRIPTION OF THE DRAWINGS

In order that the invention may be more clearly understood, reference will now be made to the accompanying drawings which show certain embodiments thereof by way of example and in which:

FIG. 13 is a top plan of arms carrying resilient toe-clamps, FIG. 14 is an elevation showing a detail of FIG. 13, FIG. 15 is a top plan of arms with a different embodiment of resilient toe-clamps and pressure springs, FIG. 16 is a top plan of arms with still another embodiment of resilient toe-clamps and spiral springs, FIG. 17 is a top perspective of a detail of FIG. 16 (a spiral spring whose tension can be adjusted), FIG. 19 is a perspective of another embodiment of front binding, and FIG. 19A is a fragmentary perspective of such binding with parts in different positions, FIG. 20 is a side elevation of the front binding of FIG. 19, FIG. 21 is a side elevation of a front binding having a raisable sole plate.

DETAILED DESCRIPTION OF PREFERRED EMBODIMENTS

Figure 1:
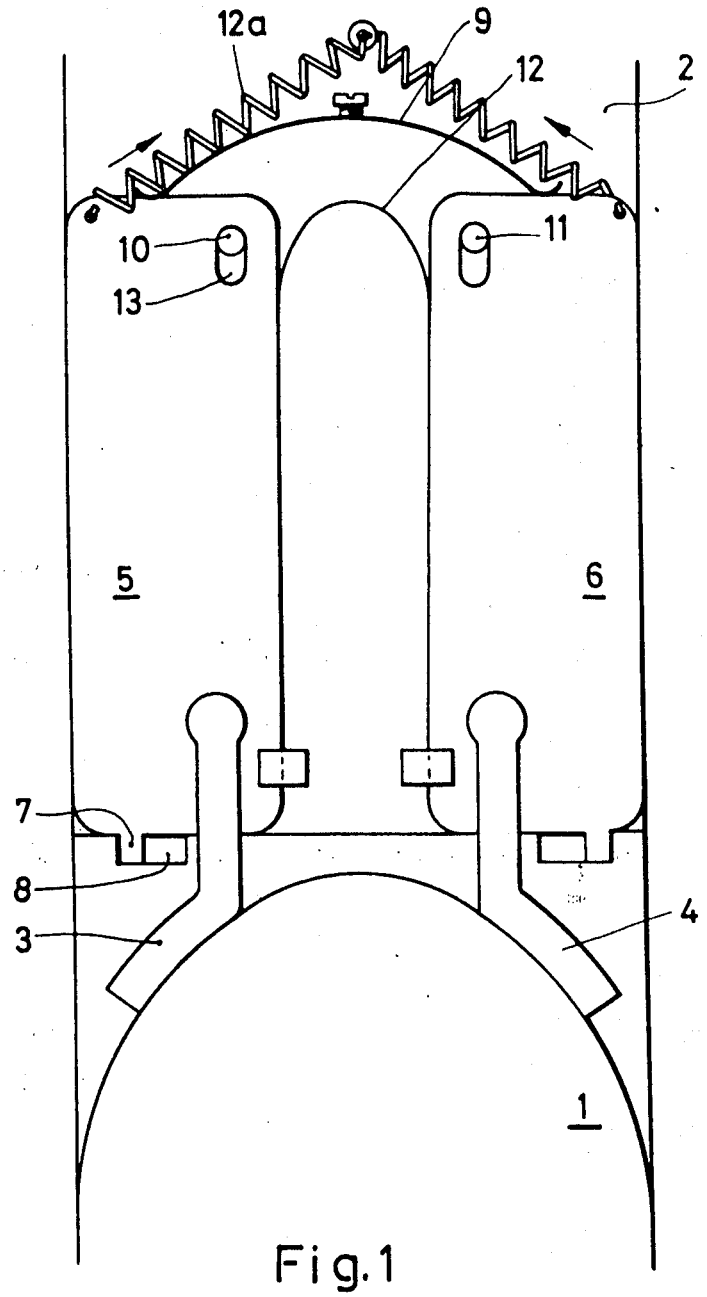
FIG. 1 is a schematic top plan of a front binding in the closed position.
Figure 2:
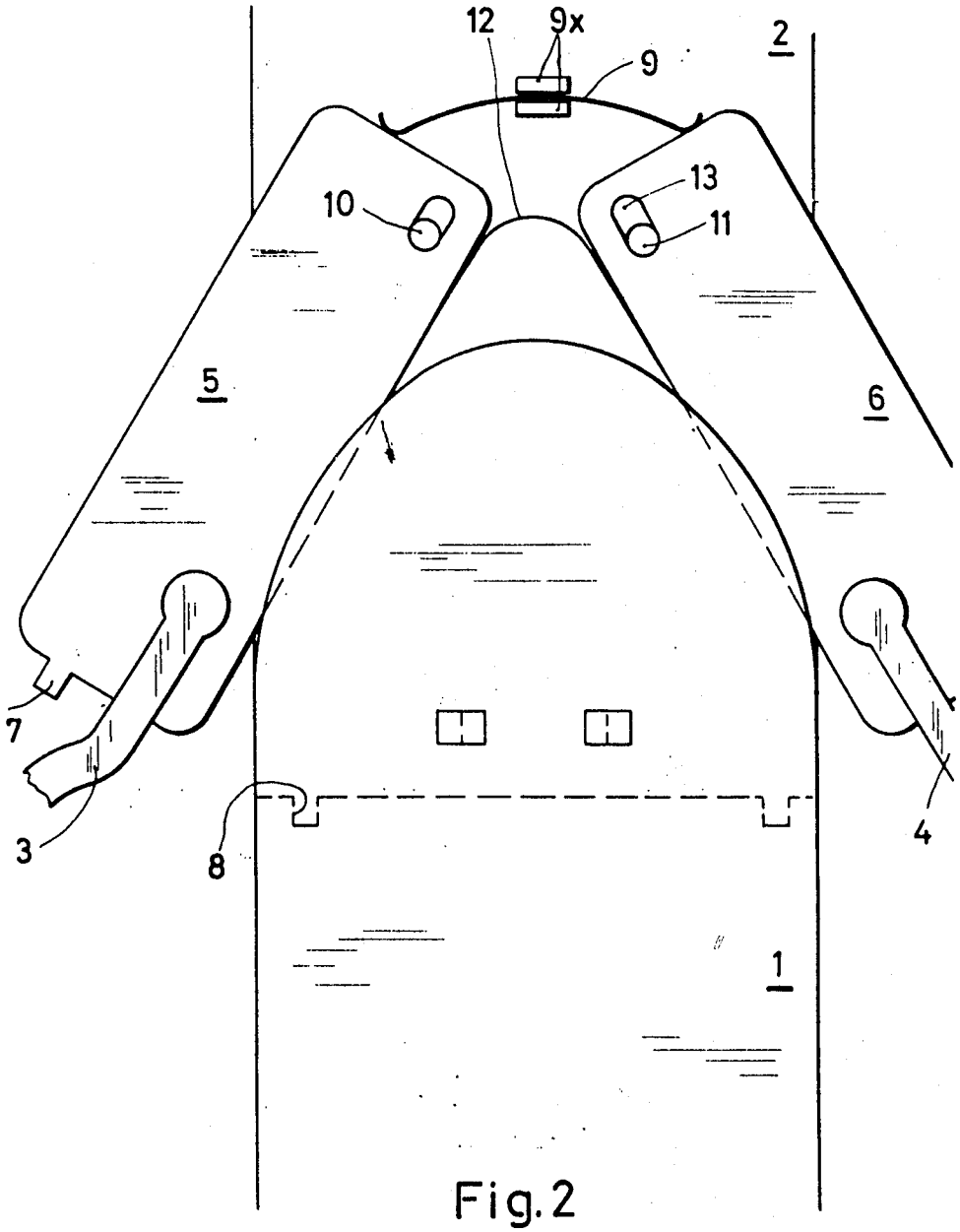
FIG. 2 is a similar view showing the front binding of FIG. 1 in the open position.
Figure 3:
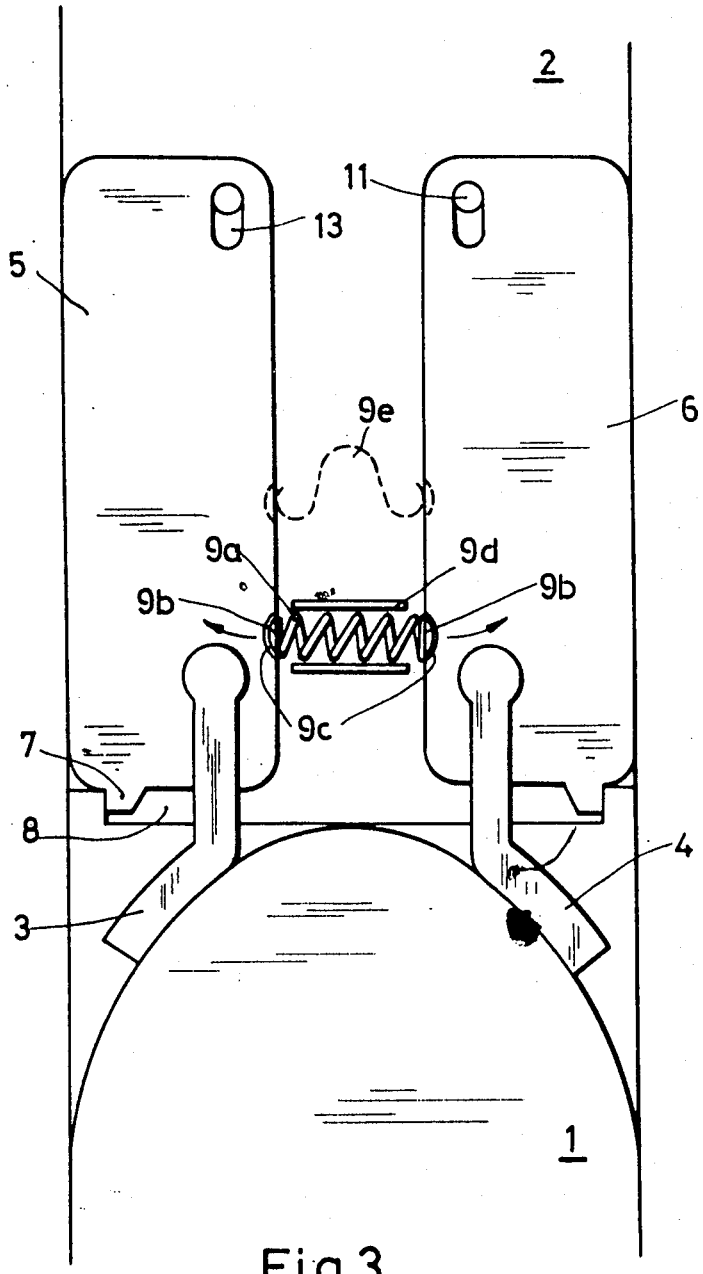
FIG. 3 is a top plan of a front binding with a transverse pressure spring.

Referring now to the drawings as shown in FIGS. 1 to 3, a front binding for holding a ski-boot 1 on a ski 2, includes toe-clamps 3 and 4 which are in the form of sole grips and which are mounted on outwardly swingable arms 5 and 6. The arms 5 and 6 have latch fingers 7 which engage in corresponding recesses 8 for normally maintaining the toe-clamps in the closed or boot-gripping position (FIG. 1). The arms 5 and 6 are held in this locked position by a leaf spring 9 which may be carried in mountings 9*x* (FIG. 2).

The arms 5 and 6 are swingable about pivot pins 10 and 11 as shown in FIG. 2. A bent leaf spring 12 arranged between arms 5 and 6 exerts a spreading force on the arms and assists their spreading movement when latch fingers 7 are disenaged from recesses 8. Such movement may be boosted by a tension spring 12*a*.

To release the lock on the arms 5 and 6, the arms are movable longitudinally relative to the ski, for which purpose the slots 13 in arms 5 and 6, through which the pivot pins 10 and 11 project are elongated.

When one or both of the skier's ski tips encounter an obstacle, the skier's momentum causes ski-boot 1 to exert pressure on clamps 3 and 4. If this pressure is stronger than that exerted by spring 9, arms 5 and 6 are displaced longitudinally relative to the ski, fingers 7 are moved out of their cooperating recess means 8; and, as a result of the shift in bodyweight in the direction of movement and/or the resilient action of spreader spring 12, the arms swing about their respective pivots 10 and 11 from the position shown in FIG. 1 to that shown in FIG. 2. In this way the ski-boot 1 is able to slide straight forward between the clamps 3 and 4, which have been spread apart by such swinging of arms 5 and 6, so that the skier's foot is released from the ski.

In FIG. 3 a compression spring 9*a* is mounted between the arms 5 and 6 in a mounting 9*d*. End-pieces 9 on the compression spring 9*a* engage in recesses 9*c* of arms 5 and 6. If the skier is thrown forward and arms and 6 are shifted towards the tip of the ski by an excess pressure, the ends of the spring are forced out of the recesses, the latches 7 are released and ends of arms 5 and 6 carrying toe-clamps 3 and 4 are then able to spread transversely of the ski simultaneously. Spring 9*a* assists this spreading movement. A folded leaf spring 9*e* (shown in broken lines) may be utlized as the spreader spring.

To make it possible for the ski-boot 1 to slide forward when the arms 5 and 6 are in the spread position, the upper faces of arms 5 and 6 should be at a lower level than the plane of the sole of the boot. For constructional reasons, it may also be necessary to provide gently rising ramps on the top of the arms to ensure that the boots have no difficulty in sliding forwards and out. The pivot pins 10 and 11 and 10*a* and 11*a* (FIG. 4) may have caps 14 such as are shown by way of example in FIG. 5.

In the case of the embodiment shown in FIGS. 1, 2 and 3, the pivot points for the arms 5 and 6 and for the clamps are situated in front of the ski-boot when the latter is held in the binding.

Figure 4:
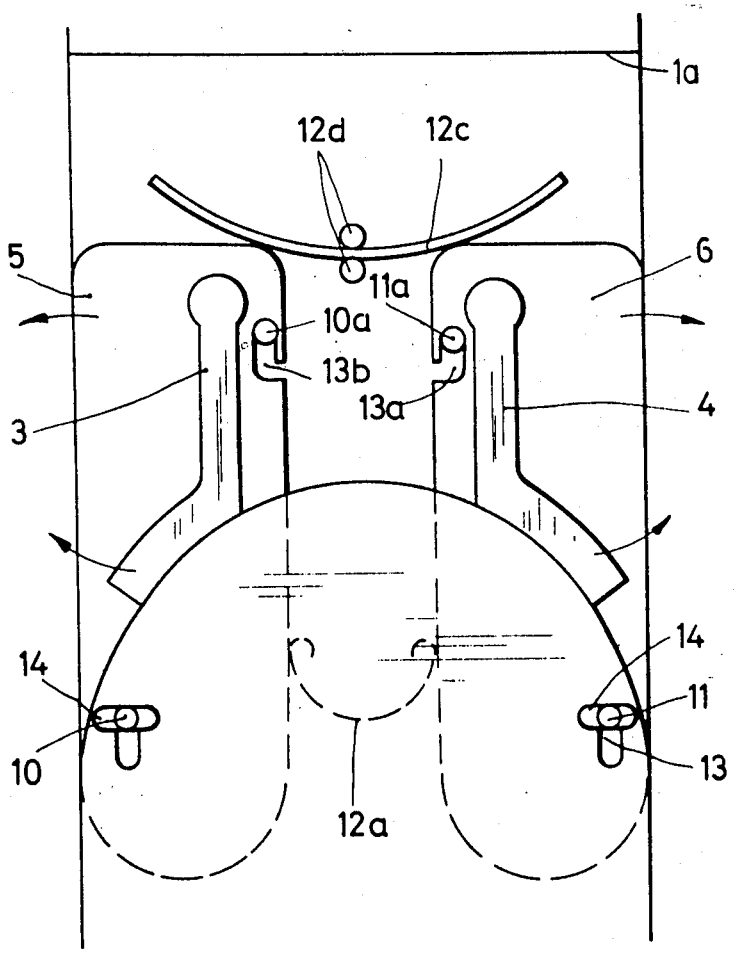
FIG. 4 is a top plan of another embodiment of front binding in the closed position.
Figure 5:
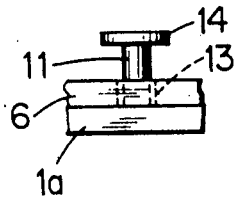
FIG. 5 is an elevation of a detail of FIG. 4.

However, as the embodiment in FIG. 4 shows, it is also possible for the clamps 3 and 4 to be arranged on the arms 5 and 6 in front of the boot while the pivot pins 10 and 11 are arranged underneath the toe of the boot. In this case, the pivot points should be situated as close as possible to the outer edges of the ski, whereas in the embodiment shown in FIGS. 1 and 2 they are arranged as close together as possible, in order to maximize the increment of distance moved by each toe-clamp for a particular degree of rotation of each arm about its pivot pin. In addition, the caps 14 must be situated above the arms 5 and 6 so that they can serve as supports for the ski-boot to allow the arms to move freely.

One end of each of arms 5 and 6 is pivotally held by pivot pin 10 or 11 and the swinging arm end is retained against retainer pin 10*a* or 11*a*. Retainer pins 10*a* and 11*a* project through slots 13*a* and 13*b* which have a portion elongated longitudinally of the ski and an added guide portion extending substantially transversely of the elongated portion. The guide portion opens through the side of the respective arm to permit separation of the retainer pin and the arm.

A spring 12*c*, which is carried in a mounting 12*d*, presses on arms 5 and 6 in the direction opposite to the direction of ski movement for normally maintaining the retainer pins 10*a* and 11*a* in the closed ends of slots 13*b* and 13*a*. If, in the event of a fall, the body exerts a forward pressure on arms 5 and 6, the arms slide simultaneously towards the point of the ski by virtue of the elongated portions of slots 13*a* and 13*b*.

When the retainer pins 10*a* and 11*a* are aligned with the transverse guide portions of the slots 13*a* and 13*b*, arms 5 and 6 are able to spread outwardly. The spreading action is assisted by spreader spring 12*a*.

Figure 8:
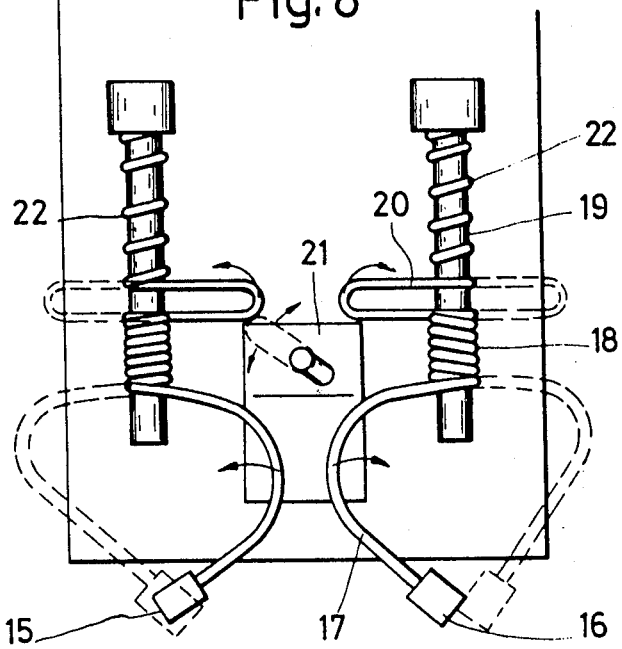
FIG. 8 shows the embodiment of FIG. 6 in the open position.
Figure 9:
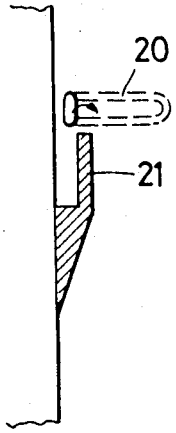
FIG. 9 is a section similar to FIG. 7, but with parts in different relationship.
Figure 6:
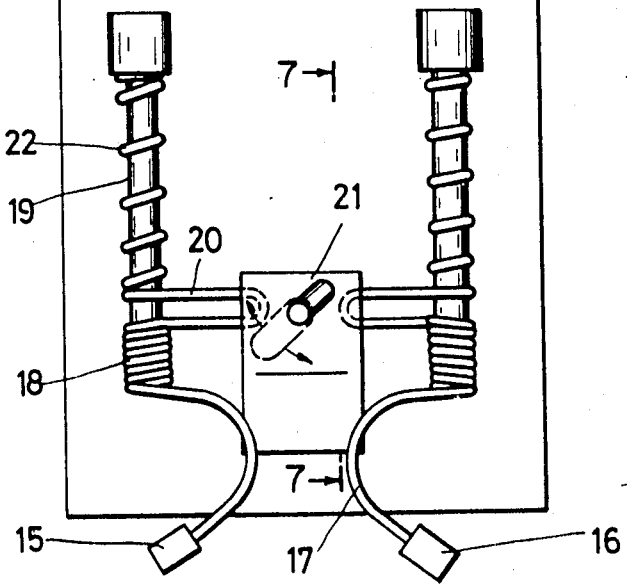
FIG. 6 is a top plan of a further embodiment of front binding in which the locking action of the arms is released by rotating the clamps, the device being shown in the closed position, FIG. 7 section taken on line 7—7 of FIG. 6.
Figure 7:
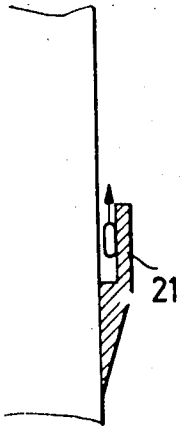

In the case of the embodiment shown in FIGS. 6 and 8, toe-clamps 15 and 16 are mounted on corresponding ends of bent arms 17, the other ends of which arms are formed into torsion springs 18. The coil-springs 18 are slidably mounted on rods 19 which extend in the longitudinal direction of the ski. As a result of the arrangement, the clamps 15, 16 are able to be displaced in the longitudinal direction. A locking loop 20 connected to the torsion spring 18 projects transversely of rod 19 and swingable about the rod. When clamp 15 or 16 is in its rearmost position and the locking loop 20 is turned inward and engages under a cantilever stop 21, the locking loop is prevented from turning by such stop and spring 18 is stressed to bias the locking loop to swing upwardly and outwardly about rod 19. The clamps are prevented from moving forward by helical compression springs 22 which are also arranged on the respective rods 19. If a pressure higher than the force exerted by springs 22 acts on clamps 15, 16 in the direction of travel, torsion springs 18, and with them the locking loops 20, move forward on rods 19 until locking loops 20 escape from their stops 21. Under the resilient action of springs 18 the clamps are now able to rotate so that the ski-boot can slide forward and out between them (position shown in broken lines in FIG. 8).

Figure 12:
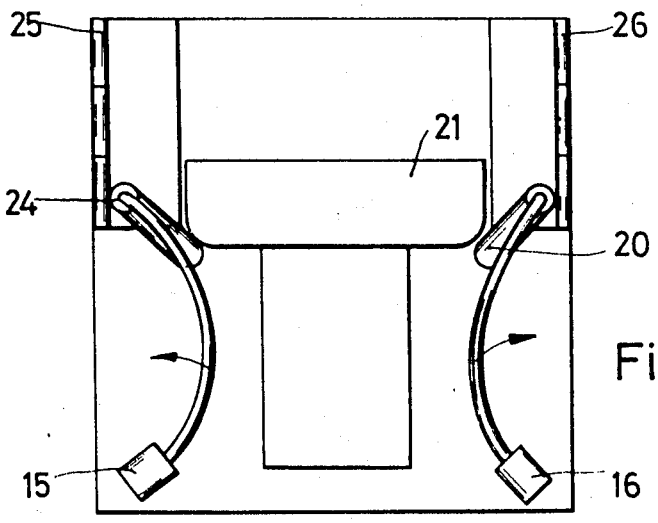
FIG. 12 is a top plan of the embodiment of FIG. 10 in the open position.
Figure 11:
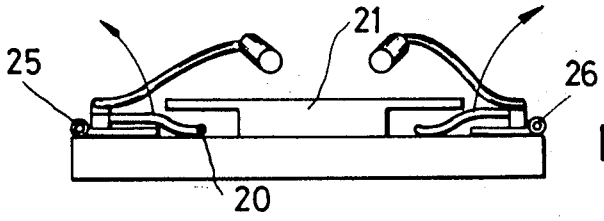
FIG. 11 is a vertical section transversely of the ski of the same embodiment in the same position, looking toward the toe of the ski.
Figure 10:
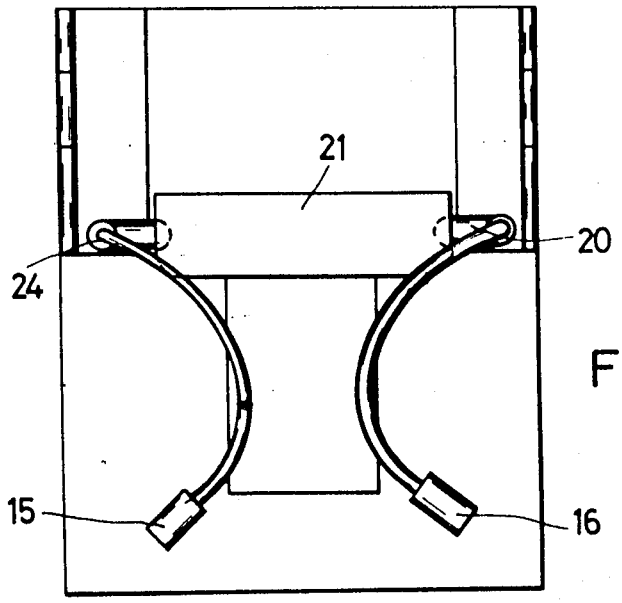
FIG. 10 is a top plan of a further embodiment of front binding, similar to that of FIG. 6, in the closed position.

In the case of the embodiment in FIGS. 10 and 12, the toe-clamps 15 and 16 are able to rotate about pivot pins and the rotary movement in turn releases the lock between locking members 20 and stops 21. When the lock is released, the mountings for the pivot pins can fold outwards, together with the clamps, by means of hinges 25 and 26. The ski-boot can then slide forward without obstruction.

In all the embodiments it is advantageous for the forces exerted by the individual springs acting on the arms and/or clamps to be adjustable, or else for the springs to be interchangeable, so that the release mechanism can be set to individual requirements.

The various embodiments, also provide, as do known front-bindings, for sideways release in the event of sideways pressures.

After release the bindings can be reset to their original positions.

In FIGS. 13 and 14 the clamps 3*a* and 4*a* are made of a resilient material. Posts 27 and 30 fixed on arms 5 and 6 are slotted to receive the ends of clamps 3*a* and 4*a*. Pins 28 and 29 connect the posts and clamps so that the latter can be interchanged to suit the weight and build of the skier. Once pins 28 and 29 have been removed, the clamps can be taken off and replaced by clamps of a different resilience, after which the rods are replaced again.

In the embodiment in FIG. 15, the clamps 3*b* and 4*b* are rotatably mounted on posts 32 and 33 carried by arms 5 and 6. Compression springs 34 and 35 react between the clamps and posts 36 and 37 to bias the clamps toward the ski-boot toe. In the event of sideways pressure exerted on the clamp by ski-boot, the spring compresses and the clamp concerned releases the ski-boots sideways and once the boot has been released snaps back to its rest position, which is fixed for it by a stop 36*a*.

In another embodiment (FIGS. 16, 17) the clamps 3*b* and 4*b* are rotatably mounted on posts 32 and 33. In this case however spiral springs 38 and 39 are fitted on posts 32 and 33 to produce the resilient movement. The spiral springs provide the requisite spring loading for the clamps. The clamp end remote from the boat is formed as a hook encircling its pillar, the end of such hook being engageable with stops 40 and 41 to establish the normal boot-clamping position of the clamps.

The spiral springs are advantageously interchangeable to suit the build and size of the skier.

Figure 18:
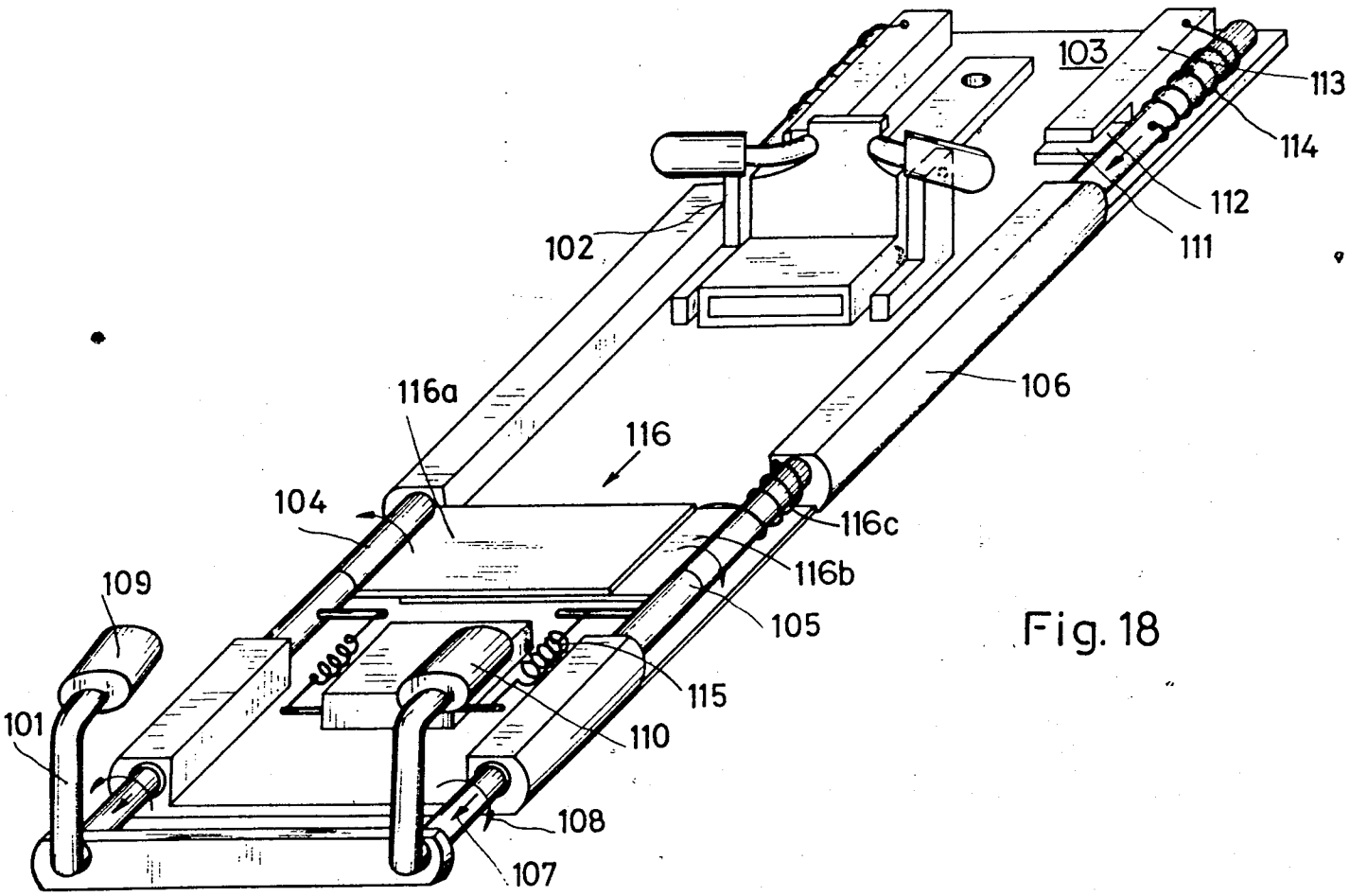
FIG. 18 is a perspective view of a ski-binding.

The ski-binding shown in FIG. 18 consists of a front binding 101 and a heel binding 102 which are mounted on a common sole plate 103. The sole plate is solidly secured to a ski which is not shown.

The front binding 101 includes two rotatable rods 104 and 105 extending lengthwise of the ski which rods are supported by mounting sleeves or guideways 106 adjacent opposite sides of the ski to be displaceable longitudinally of the ski (as indicated by arrows 107) and rotatable about their respective longitudinal axes (as indicated by arrows 108). At the front end of each rotatable rod is mounted a clamp 109 or 110, the function of which is to grip the toe of the ski-boot. Both of these clamps 109 and 110 are above to pivot outwards if a strong, forwardly acting pressure is exerted on them, thus releasing the toe of the boot.

At the rear end of each rotatable rod 104 or 105 is a locking arrangement which prevents the rod from rotating under normal skiing conditions. In FIG. 18 a lateral projection 111 carried by the rotatable rod 105 adjacent its rearward end is engageable in a recess 112 formed by the forwardly extending cantilever end of a locking member 113. There is also a torsion spring 114 mounted on rod 105 and having one end connected thereto and the other end connected to member 113. Spring 114 biases rod 105 to turn in the direction of arrow 10 when the rod is unlocked as a result of its being moved forward in the direction of arrow 107. A compression spring 115 retains rotatable rod 105 in its rearward position until a pressure is exerted on clamps 109 and 110 which is exceeds the rearward force exerted by the retainer spring.

As is further shown by FIG. 18, the rotatable rods 104 and 105 also act as supports for a ski-brake 116 arranged between the front binding 101 and the heel binding 102. The brake includes overlapping leaves 116a and 116b supported on rods 104 and 105, respectively, by sleeves independently rotatable about the axes of such rods. The leaves are swung by a torsion spring 116c encircling the brake leaf supporting sleeve. One end of the spring is connected to the underleaf 116b to assist swinging of that leaf which, in turn, lifts the overleaf 116a. When the ski boot is released from the binding, the leaves can swing about rods 104 and 105 so that the leaves are swung outward and downward to bite into the snow.

In the case of the embodiment in FIG. 19, rotatable rods **105*a* are provided at the edges of the ski, which rods are shorter than rods 105 shown in FIG. 18. At the front end of rotatable rod 105*a* is again mounted an outwardly pivotable clamp 110. The rear end of rotatable rod 105*a* is provided with interlock members 117 which, when the rotatable rod 105*a* is in its rearward position, fit into a suitably shaped companion member 117*a*. A spring 118 mounted on rotatable rod 105*a* acts as a torsion and compression spring and both prevent clamps 109 and 110 from moving forward and, when the locking arrangement 117, 117*a* has been released, rotates rotatable rod 105*a*** outwards.

As FIG. 19 also shows, spring 118 is connected to a pressure adjuster 119 by means of which collar **119*a* through which rod 105*a* passes can be set relative to locking member 117*a*** to alter the force exerted by the spring to suit the weight of the skier.

As FIG. 20 shows, in an advantageous embodiment the rotatable rod consists of two parts 120 and 121, which are connected together by a coupling 122. By means of this coupling, the overall length of the rotatable rod can be altered and can thus be adapted to the length of the skier's boots.

FIG. 20 also shows that the clamp 123 is connected to the rotatable rod by means of a threaded connector 124 or the like so that the distance between the clamp 123 and the sole plate or the upper face of the ski can be altered.

FIG. 21 is a diagram showing sole-plate 125 which may be common to all parts of the binding. The sole-plate is hinged to the ski 127 at its front edge by a hinge pin 126. The rear edge of the sole-plate 125 contains a recess 128 in which a locking projection 129 engages when the sole-plate is to be locked to the face of the ski, as indicated by the broken lines. The raisable sole-plate 125 makes climbing easier without adversely affecting the operation of the ski-binding according to the invention when progressing normally.

Figure 22:
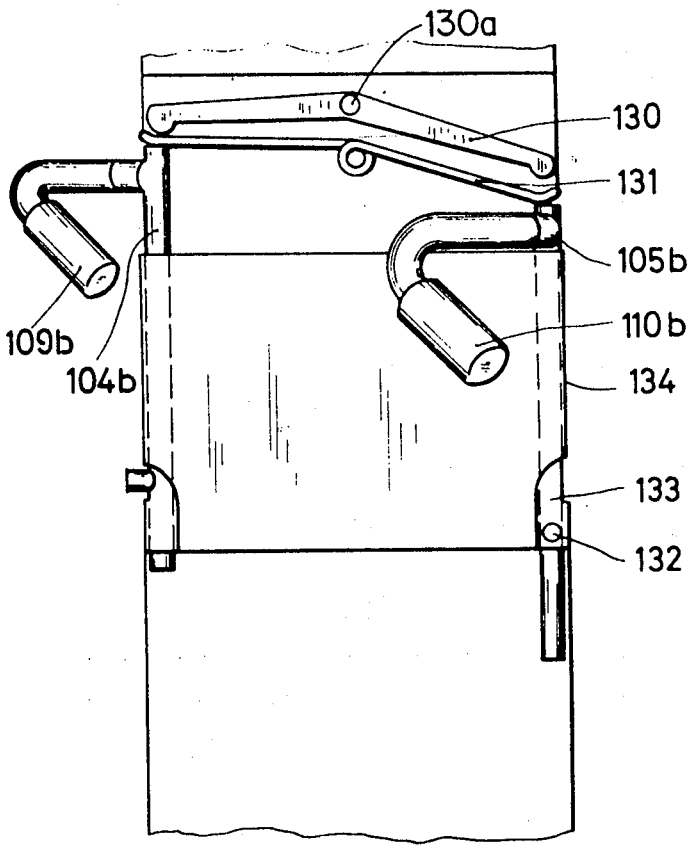
FIG. 22 is a top plan of a further embodiment of a front binding in a condition for releasing a ski-boot to one side.

In the case of the embodiment in FIG. 22, the clamps **109*a* and 110*b* are still mounted on the front ends of rotatable rods 104*b* and 105*b* which extend in the longitudinal direction of the ski. However, in contrast to the embodiment in FIGS. 18 and 19, a strong spring 130 swingable about an upright pivot pin 130a is provided which can act on both the rotatable rods from the front when they are displaced forwardly from their latched positions. Between this spring and the rotatable rods is provided lighter spring 131 which normally engages both rods 104*b* and 105*b*. In the event of a moderate impact, only the force exerted by the weaker spring 131 is exceeded and only the clamp which receives the impact is rotated outwards so that the toe of the ski-boot can travel out sideways. Depending on the forward force component resulting from the impact, the displaced rod may engage some force of spring 130, but such force will be minimal because the spring will pivot about pin 130*a*. Only when the forward force component is sufficient to displce both rods 104*b* an 105*b* sufficiently to engage opposite ends of spring 130, such as in the event of a more violent, head-on impact, with the full force of the stronger spring 130** be effective. When that force is exceeded, both clamps rotate outwards simultaneously to allow the ski-boot to slide out in the longitudinal direction of the ski.

The interlocking means for holding the rods in their normal rearward position includes projections 132 mounted near the rear ends of the rotatable rods **104*b* and 105*b*, which projections are guided by cam slots 133 in guide sleeves 134**.

I claim:

1. A safety binding for skis having a front binding including two arms each carrying a toe-clamp, such toe-clamps being spaced apart and normally engageable with the toe of a ski-boot, the improvement comprising spring means exerting a predetermined force on the arms in a direction substantially longitudinally and rearwardly of the ski for maintaining the toe-clamps in boot toe engaging position, moving means responsive to a forward force exceeding such predetermined rearward force for simultaneously moving such toe-clamps apart transversely of the ski a distance greater than the width of a ski-boot including pivot means having their axes extending substantially longitudinally of the ski the arms being swingable about the axis of said pivot means, biasing means for urging simultaneous swinging of the arms about said pivot means, and means for latching the arms against swinging.

2. The safety binding defined in claim 1, in which the arms are rods having their lengths disposed substantially longitudinally of the ski, said rods longitudinally of the ski and axes extending substantially longitudinally of the ski and being displaceable lengthwise, and means for mounting said rods in substantially parallel spaced relationship adjacent to opposite sides of the ski.

3. The safety binding defined in claim 2, and further having a heel binding including heel-clamps, the improvement further comprising the rearward end portion of a rod projecting rearwardly of the heel binding, latch means for latching such rod against rotation, including a fixed member disposed rearwardly of the heel binding and a member carried by such rod rearward end portion and engageable with said fixed member in the normal boot-clamping position of such rod and disengageable by displacement of such rod, and means for altering the length of the rod portion between the toe-clamp carried by such rod and the heel binding.

4. The safety binding defined in claim 2, and ski-brake means carried by the rods.

5. The safety binding defined in claim 1, in which the moving means includes means for moving the arms longitudinally of the ski.

6. The safety binding defined in claim 1, in which the biasing means are torsion springs carried by each rod, and means for adjusting the force of the spring means and the biasing means.

7. The safety binding defined in claim 1, and a sole-plate carrying the front binding, the spring means and the moving means, hinge means connecting the forward edge of such sole-plate and a ski and having its hinge axis disposed transversely of the ski, and latch means for latching the rearward edge of said sole-plate for maintaining said sole-plate in a position in substantially parallel overlying relationship with the ski.

* * * * *

UNITED STATES PATENT OFFICE

CERTIFICATE OF CORRECTION

Patent No. 4,017,098 Dated April 12, 1977

Inventor(s) Bernhard Kirsch

It is certified that error appears in the above-identified patent and that said Letters Patent are hereby corrected as shown below:

Column 1, line 32, insert a comma after "toe-clamps".

Column 6, claim 2, lines 65, 66 and 67, cancel "longitudinally of the ski and axes extending substantially longitudinally of the ski and".

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*